United States Patent [19]

Pavlica

[11] 4,025,417

[45] May 24, 1977

[54] HYDROPROCESSING CATALYTIC CRACKING FEED STOCKS

[75] Inventor: Robert T. Pavlica, Cherry Hill, N.J.

[73] Assignee: Mobil Oil Corporation, New York, N.Y.

[22] Filed: May 19, 1975

[21] Appl. No.: 578,443

Related U.S. Application Data

[63] Continuation-in-part of Ser. No. 469,170, May 13, 1974, abandoned.

[52] U.S. Cl. ..... 208/57; 208/89; 208/144

[51] Int. Cl.[2] ..... C10G 37/06

[58] Field of Search ..... 208/57, 89, 143, 144

[56] References Cited

UNITED STATES PATENTS

| | | | |
|---|---|---|---|
| 2,717,864 | 9/1955 | Charlet et al. | 208/57 |
| 2,925,374 | 2/1960 | Gwin et al. | 208/57 |
| 3,098,029 | 7/1963 | Snyder | 208/57 |
| 3,506,568 | 4/1970 | Annesser et al. | 208/89 |
| 3,671,419 | 6/1972 | Ireland et al. | 208/57 |
| 3,700,586 | 10/1972 | Schulman | 208/57 |

*Primary Examiner*—Herbert Levine

*Attorney, Agent, or Firm*—Charles A. Huggett; Vincent J. Frilette

[57] ABSTRACT

Hydroprocessing a high boiling hydrocarbon feed, such as coker gas oil, containing an aromatic carbon content of at least 35%, thereby reducing the aromatic carbon content level to less than 35% but not less than about 20%, prior to inclusion of this FCC feed component with the remainder of the FCC feed or cracking it alone with a crystalline zeolite aluminosilicate in a catalytic cracking zone.

5 Claims, No Drawings

HYDROPROCESSING CATALYTIC CRACKING FEED STOCKS

CROSS-REFERENCE TO RELATED APPLICATIONS

This Pat. application is a continuation-in-part of U.S. Pat. application S.N. 469,170 filed May 13, 1974 now abandoned.

BACKGROUND OF THE INVENTION

1. Field of the Invention

The present invention relates to catalytic cracking with catalysts comprising crystalline zeolite aluminosilicates. More particularly, the present invention is concerned with hydroprocessing hydrocarbon feeds containing high concentrations of aromatic compounds followed by catalytic cracking of the hydrofined feeds in the presence of crystalline zeolite aluminosilicate catalysts.

2. Description of the Prior Art

A principal process in the petroleum industry by which high boiling hydrocarbons are converted to lower boiling products, including gasoline, is catalytic cracking. Catalytic cracking is to be distinguished from hydrocracking. Hydrocracking involves hydrogenation at temperatures high enough for cracking to occur, whereas catalytic cracking primarily involves cracking in the absence of hydrogen, thereby preventing significant hydrogenation. A distinctive feature of catalytic cracking is the high octane quality of the gasoline produced, resulting from the presence of high concentrations of branched chain paraffin hydrocarbons and olefin hydrocarbons. Catalytic cracking also yields highly unsaturated $C_3$ and $C_4$ fractions, and high concentrations of isobutane.

Improvement in the quality of coker gas oil as a catalytic cracking charge stock is disclosed in U.S. Pat. No. 3,098,029 issued July 16, 1963. Hydrofinishing high nitrogen content hydrocarbons followed by catalytic cracking with zeolite aluminosilicates is disclosed in U.S. Pat. No. 3,506,568 issued April 14, 1970.

SUMMARY OF THE INVENTION

It has been found that relatively mild hydroprocessing of petroleum distillate oils with an aromatic carbon content (%CA) greater than 35% produces unusually large improvements in product distribution when the fraction is subsequently cracked with a zeolite aluminosilicate catalyst. Coker gas oils are particularly benefited by mild hydroprocessing. By mild hydroprocessing is meant a hydroprocessing treatment that reduces the %CA into the range of about 20% to less than 35%. The hydroprocessed fraction is contacted either alone or blended with other low percent $C_A$ virgin gas oil fractions with a catalyst comprising a crystalline zeolite aluminosilicate in which the pore dimensions are at least 6A under catalytic cracking conditions in a catalytic cracking zone.

DETAILED DESCRIPTION OF THE INVENTION

The present invention will be more fully explained and understood by reference to Table 1 illustrating the catalytic cracking conversion to products as a function of aromatic carbon content. The aromatic carbon content, expressed as $\%C_A$ in Table 1 and elsewhere in this specification, is to be determined by the n-d-m method (refractive index, density and molecular weight) as described in the text book "Aspects of the Constitution of Mineral Oils", by Van Nes and Van Westen, published by Elsevier Press, Houston, Tex., (1951) the contents of which are herein incorporated by reference. This determination estimates the percentage, or weight percent, of the total carbon that is in the aromatic rings.

It is found that although catalytic cracking with zeolite aluminosilicates results in higher conversion of the feeds to lower boiling products than amorphous catalysts, the conversion is accompanied by higher coke yields. Since most commercial catalytic cracking processes are limited by their coke-burning capacity, conversion may be limited thereby.

As a specific embodiment, by use of the invention improved results can be obtained in a catalytic cracking process comprising a reaction zone wherein a hydrocarbon feedstock is converted and a regeneration zone wherein coke is burned from the catalyst, between which zones cracking catalyst is continuously circulated, wherein a portion of the feedstock available for catalytic cracking contains above 35% aromatic carbon content and wherein limitations in the coke burning capacity of said regeneration zone impose an upper limit on the conversion attainable in said reaction zone.

The hydroprocessing for purposes of the present invention is done under sufficiently mild conditions so that the aromatic carbon content of the product is reduced only to within the range of about 20% to below 35%. Furthermore, the treatment should be sufficiently mild so that the hydrotreated fraction retains at least 600 ppm total nitrogen. It is preferred that the hydroprocessing of the feedstock having an aromatic carbon content greater than 35% be under such conditions, as hereinafter more fully specified, that the resulting hydroprocessed oil will contain an aromatic carbon content of about 25%.

In general, the process of the present invention is preferably applied to hydrocarbon feeds having an initial boiling point above about 450° F. and an end point below about 1100° F. The feeds for purposes of the present invention are those having an aromatic carbon content greater than 35 percent. Coker gas oil is exemplary. The feeds can contain sulfur and metal contaminants along with nitrogen. Suitable feeds include any petroleum oils that have an aromatic carbon content greater than 35%, whether these be derived by simple fractionation or other processes such as coking. Petroleum distillate oils are preferred since these are generally characterized by a low metals content and are therefore particularly suitable for subsequent catalytic cracking.

The hydroprocessing is conducted under conditions of temperature, pressure, hydrogen flow rate and liquid hourly space velocity in the reactor correlated to provide the desired degree of reduction of the aromatic carbon content. Higher temperatures, pressures, and hydrogen flow rates are used when treating the higher boiling feedstocks and those containing greater amounts of aromatic carbon content.

The temperature has a large influence on the rate of conversion of the aromatic compounds, and is adjusted upwards to maintain the proper degree of hydroprocessing as the catalyst ages or is deactivated through prolonged use. The temperature should be in the range 550° to 800° F. and preferably in the range 650° to 750° F. At temperatures below 550° F. the rate of hydroprocessing or aromatic ring removal, is too low for practical purposes, whereas at temperatures above about 800° F. substantial cracking of the feed occurs, and coke formation tends to increase markedly. The temperature used will also depend on the activity of the hydroprocessing catalyst, higher temperatures being used with a less active catalyst.

The pressure should be maintained within the range 300 to 3000 p.s.i.g. and preferably within the range from 500 to 2000 p.s.i.g. Elevated pressures advantageously influence the rate and extent of hydroprocessing, as well as extend the catalyst activity and life. However, higher pressures increase the cost of the hydroprocessing operation.

The liquid hourly space velocity (LHSV), that is, the flow of hydrocarbon feed relative to the catalyst, will generally be in the range 0.25 to 4.0 and preferably within the range of 0.5 to 1.5. In general, the aromatic ring compounds found in high boiling hydrocarbon feeds are considered more resistant to hydroprocessing than those found in lower boiling feeds. Hence, the space velocity is generally lower for higher boiling feeds, but depends significantly on the other hydroprocessing conditions as well as the desired degree of aromatic ring removal.

The flow of hydrogen into the reactor is maintained above about 1000 s.c.f./bbl. of feed and preferably in the range 2000 to 6000 s.c.f./bbl. and more preferably, 2500 to 3500 s.c.f./ bbl. More generally, at least sufficient hydrogen is provided to supply that consumed in the conversion of aromatic ring compounds and compensate for incidental hydrogenation of nitrogen and oxygen and sulfur compounds, while maintaining a significant excess of hydrogen partial pressure. Hydrogen can be added to the feed prior to introduction of the feed into the reactor; or the hydrogen can be added separately to the reactor. The hydrogen consumption will generally be within the range 400 to 1500 s.c.f./bbl. of feed depending of the properties of the hydrocarbon feed and the other hydroprocessing conditions used. Excess hydrogen is removed from the treated oil, and preferably purified and recycled to the reaction zone.

In the hydroprocessing zone the feed plus added hydrogen is contacted with any suitable hydroprocessing catalyst. Suitable hydroprocessing catalysts generally comprise the Group VIII metals, their oxides and/or sulfides thereof mixed with Group VI-B metals, their oxides and/or sulfides thereof. The metal composites may be used in the undiluted form but preferably exist in combination with a support. Suitable carriers or supports are the inorganic oxides, for example, alumina, silica, zirconia, titania, bauxite, magnesia, fuller's earth, and combinations thereof. The metal content on a support preferably ranges between about 2 percent and 25 percent by weight. Suitable hydroprocessing catalysts contemplated for use in the present invention include cobalt oxide and molybdenum oxide on silica-alumina; sulfided nickel and tungsten on alumina; and nickel-molybdenum on alumina. A particularly good catalyst is nickel and molybdenum on a silica-alumina support.

The form in which the hydroprocessing catalyst is used will depend on the type of process involved in the hydroprocessing operation, that is whether the process involves a fixed bed, moving bed of fluid operation. Generally, the catalyst will exist in beads, tablets or extruded pellets for use in fixed bed or moving bed operations, and in powder form for use in fluid operations. If the catalyst maintains high activity over protracted periods or use, the hydroprocessing is preferably carried out using a fixed bed of catalyst in a reactor. Catalyst regeneration can be periodically accomplished by subjecting the catalyst to an oxygen-containing atmosphere at elevated temperatures to remove carbon deposits formed during extended use.

Following the hydroprocessing operation, the hydroprocessed feed may be treated so as to remove any contaminants, such as ammonia, which may be present. Removal of ammonia may be accomplished, for example, by injecting water or acidified water into the hydroprocessed feed and passing the resulting mixture into a separator operating under such conditions that a water phase containing essentially all the ammonia present in the hydroprocessed feed can be removed. Further purification of the hydroprocessed feed can be accomplished in a stripper or a distillation column. For purposes of the present invention, however, it is not considered essential to treat hydroprocessed feed to remove the contaminants produced during hydroprocessing. Hence the hydroprocessed feed can generally be catalytically cracked in the presence of the zeolite aluminosilicate catalyst without intervening purification.

At least a portion and preferably all the upgraded hydroprocessed oil containing from about 20% to below 35% aromatic carbon content can be cracked in the presence of a catalyst comprising a crystalline zeolite aluminosilicate. Both the natural and synthetic zeolite aluminosilicates may be used for purposes of the present invention. Crystalline zeolite aluminosilicates comprise aluminosilicate cage structures in which alumina and silica tetrahedra are intimately connected with each other in an open three dimensional network. The tetrahedra are cross-linked by the sharing of oxygen atoms. In general, the spaces between the tetrahedra are occupied by water molecules prior to dehydration. Dehydration results in crystals interlaced with channels or pores of molecular dimensions which channels or pores selectively limit the size and shape of foreign substances that can be adsorbed. Thus, the crystalline zeolitic aluminosilicates are often referred to as molecular sieves. In the hydrated form the aluminosilicates can be represented by the basic formula:

$$M_{2/n}O:Al_2O_3:wSiO_2:yH_2O$$

wherein M is a cation which balances the negatic electrovalence of the tetrahedra; $n$ represents the valence of the cation; $w$, the moles of $SiO_2$; and $y$, the moles of water. In general, a particular type of crystalline zeolite aluminosilicate will have values of $w$ and $y$ that fall in a definite range. The cation, M, may be any of a number of ions, such as, for example the alkali metal ions, the alkaline earth ions, and the rare earth ions. The cations may be mono-, di, or trivalent. The zeolite cations may be replaced one with another by suitable exchange techniques. The replacement of the zeolite cations with other cations, as, for example, the replacement of sodium cations with calcium cations, generally does not include appreciable changes in the anionic framework.

The aluminosilicates which find use for purposes of the present invention possess relatively well defined pore structures. The exact type of aluminosilicate is relatively unimportant as long as the pore structure comprises openings characterized by pore dimensions greater that 6A and, in particular, uniform pore diameters of between approximately 6A and 15A. The uniform pore structure wherein the pores are greater than 6A permit hydrocarbons access to the relative sites of the catalyst. Generally, in order to obtain aluminosilicates of the necessary pore diameters, the silica to alumina ratio in the crystalline form should be greater than about 2. Appropriate zeolite aluminosilicate which find use in the present invention are the natural faujasites; synthesized zeolite X described in U.S. Pat. No. 2,882,244; and zeolite Y described in U.S. Pat. No. 3,130,007. Zeolite Y is generally more stable under catalytic cracking conditions and hence is the preferable form of the aluminosilicates.

Generally, the crystalline zeolite aluminosilicate catalyst will not contain metal hydrogenating components. However, a number of other ions may be incorporated into the aluminosilicate structure, as for example the alkali metals, the alkaline earths and the rare earths. It is preferred to maintain the sodium content of the zeolitic aluminosilicate below about 10 weight percent based on the oxide. The hydrogen form of the zeolitic aluminosilicate can also be used.

The zeolitic aluminosilicate can be employed directly as a catalyst or it can be combined with other suitable catalytic materials, as, for example, slica-alumina or silica-magnesia. Furthermore, the zeolitic aluminosilicate can be mixed with a support or binder to provide beneficial properties such as increased compactibility and attrition resistance. The particular chemical composition of the support or binder is not critical. It is, however, necessary that the support or binder employed be thermally stable under the conditions at which the cracking is carried out. The support or binder may be catalytically inert or possess catalytic activity. Such materials include by way of example kieselguhr, bauxite and various clays. The mixture can be prepared by a variety of methods, as, for example, by physically mixing and then compressing the composite, or by coprecipitation, or cogellation.

Reaction conditions depend on the type of catalytic cracking process employed, whether fixed bed, moving bed, or fluid. Furthermore, the cracking conditions depend on the nature of the feedstock, whether highly paraffinic or aromatic, etc., and upon the aromatic ring content. In general, the reaction conditions, such as temperature, pressure; and liquid hourly space velocity are correlated to provide the yield and nature of products desired.

The temperature in the catalytic cracking operation should lie within the range from 950° to 1100° F. and preferably within the range 1000° to 1050° F. Generally, increasing the temperature increases the amount of cracking or the conversion of feed to lower boiling products.

The appropriate pressure can be from subatmospheric to several atmospheres. Preferably the pressure will lie within the range 20 to 50 p.s.i.g. and more preferably, 30 to 40 p.s.i.g. The pressure has little effect on the rate of cracking although it affects the contact time. Moreover, increasing the pressure generally reduced the octane quality of the gasoline product and increases the production of coke at a given conversion.

The oil residence time is preferably maintained within the range 2 to 20 sec. and more preferably from 4 to 10 sec. The catalyst to oil ratio should be maintained between about 5 to 15 on a weight basis and preferably from 8 to 12. The catalyst to oil ratio depends on the type of process used, whether a fluid, moving bed or fixed bed, and generally higher catalyst to oil ratios are used for fluid operations. Increasing the catalyst to oil ratio normally reduces the extent of catalyst deactivation from coke production, and increases the conversion of the feed to lower boiling products.

The present process can be obtained in either fixed bed, moving bed, or fluid catalyst systems. Because of the coke laydown on the catalyst and the necessity of regenerating the catalyst periodically it is preferred to employ a contacting system wherein regeneration can be accomplished without discounting the flow of feed to the reaction zone. A particularly preferred contacting system is one involving a fluid catalyst. In this operation a finely divided solid catalyst, for example powder, is continuously recycled between a reaction zone and a separate regeneration zone. In each zone the catalyst is maintained in a fluidized state that behaves much like a liquid in the reactor. The feed is continuously contacted with freshly regenerated catalyst and the hydrocarbon products are removed from the reactor. The coked catalyst is continuously removed from the reactor and passed to a regenerator where it is contacted with an oxygen-containing atmosphere to burn the coke and regenerate the catalyst. The regenerated catalyst is then returned to the reaction zone.

The present process may be more fully understood in terms of the following examples.

EXAMPLES 1–3

Examples 1–3 as noted in Table 1 having various chargestock properties illustrate the effect of aromatic carbon content, i.e. $\%C_A$, and hydroprocessing on the yields of a fluid cracking unit.

Table 1 illustrates the dramatic and unexpected results that the aromatic carbon content ($\%C_A$) makes upon FCC gasoline production. The data under the labeling of "Base Case" (Example 1) wherein the chargestock is solely a vacuum gas oil having the feed properties as indicated shows a gasoline make of 22,700 barrels/day produced by a charge rate of 50,000 barrels/day. The second column of Table I (Example 2) shows that when the charge rate is increased to 60,000 barrels/ day through the addition of a coker gas oil high in aromatic carbon content, the gasoline production is decreased rather than increased as compared with the data of Example 1. Finally, Example 3 of Table 1 indicates the significant effects of hydrotreating the aromatic ring rich coker gas oil. Conditions for the Examples 1–3 are as follows: a pressure of 2,000 psi, a temperature of 700° F, a LHSV of 0.5, a $H_2$ circulation of 4,000 SCF/B and a NiMo catalyst, i.e. a nickel-molybdenum on alumina catalyst.

TABLE 1

| Example | 1 BASE CASE VGO ALONE | 2 ADD RAW CHGO | 3 ADD HDT CHGO |
|---|---|---|---|
| Total Feed Rate B/D | 50,000 | 60,000 | 60,000 |
| Coker Heavy Gas Oil Portion (CHGO) B/D | 0 | 10,000 | 10,000 |
| Feed Properties | | | |
| Basic Nitrogen, ppm | 1,260 | 1,720 | 1,190 |
| Sulfur, wt % | 1.23 | 1.27 | 1.02 |
| Paraffins | 8.3 | 8.3 | 9.9 |
| Naphthenes | 34.5 | 31.5 | 34.5 |
| Aromatics | 57.2 | 60.2 | 55.6 |
| Aromatic Carbon Content (% $C_A$) | 24.5 | 28.8 | 24.2 |
| FCC Yields, B/D | | Δ Yields | |
| Gasoline | 22,700 | −1200 | +4200 |
| Light Fuel Oil | 9,100 | +1380 | +1100 |
| Heavy Fuel Oil | 6,160 | +9260 | +2400 |

TABLE 1-continued

| Example | 1 BASE CASE VGO ALONE | 2 ADD RAW CHGO | 3 ADD HDT CHGO |
|---|---|---|---|
| Slurry Oil (Fixed) | 3,300 | +710 | +690 |
| Coke, M lb/hr | 44.2 | +8.6 | +8.0 |

EXAMPLES 4–7

Examples 4–7 as noted in Table 2 illustrate the percent conversion for chargestocks having varying API gravity, nitrogen content and aromatic rings content.

It had previously been thought the critical feature of a cracking unit chargestock was its nitrogen and/or basic nitrogen content. However Table 2 illustrates that it is in fact the aromatic ring content which is the critical factor. Comparing Examples 4 and 5 it is seen that holding the basic nitrogen content constant and decreasing the aromatic rings content ($\%C_A$) produces a large increase in FCC conversion. FCC conversion being defined as follows:

$$\text{Percent Conversion} = 100\left(1 - \frac{\text{BPD Light Fuel Oil \& Heavier in Product}}{\text{BPD Raw Oil}}\right)$$

Viewing the data of Table 2 as a whole it is seen that the effect of aromatic ring content on FCC performance is much more pronounced than that of total or basic nitrogen. The process conditions of the examples are also noted in Table 2; a CoMo hydroprocessing catalyst, i.e. a cobalt-molybdenum on alumina catalyst, was used in the examples shown on Table 2.

TABLE 2

| Example | 4 | 5 | 6 | 7 |
|---|---|---|---|---|
| | | HDT RUNS | | |
| | Charge | No. 1 | No. 2 | No. 3 |
| °API | 12.4 | 16.0 | 18.1 | 17.3 |
| Nitrogen (TOT) % | 1.15 | 0.90 | 0.76 | 0.90 |
| (Basic), ppm | 3600 | 2400 | 2400 | 2700 |

TABLE 2-continued

| Example | 4 | 5 | 6 | 7 |
|---|---|---|---|---|
| | | HDT RUNS | | |
| | Charge | No. 1 | No. 2 | No. 3 |
| % $C_A$, wt. % | 49 | 46 | 32 | 37 |
| FCC Conversion, Δ% | BASE | +6 | +34 | +24 |
| Pressure (psig) | | 500 | 2000 | 2000 |
| Temperature °F | | 775 | 625 | 700 |
| LHSV | | 1.0 | 0.5 | 4.0 |

What is claimed is:

1. In a process for producing gasoline and fuel oil cracked products by catalytically cracking a hydrocarbon blend comprising a major fraction of virgin gas oil and a minor fraction of coker gas oil, said coker gas oil having an aromatic carbon content greater than 35%, said process comprising blending said virgin gas oil and said coker gas oil to form said blend; cracking said blend under cracking conditions in the absence of added hydrogen with a catalyst comprising a crystalline aluminosilicate zeolite; and recovering said cracked products, the improvement, whereby increasing the yield of said cracked products, which comprises:

mildly hydroprocessing said minor fraction of coker gas oil in the presence of hydrogen and a hydroprocessing catalyst, said hydroprocessing being conducted at a temperature of 550° F to 800° F, a pressure of 300 to 3000 p.s.i.g., and at a LHSV of 0.25 to 4.0; recovering a hydroprocessed coker gas oil having at least 600 ppm total nitrogen and an aromatic carbon content of about 20% to less than 35%; and blending said recovered hydroprocessed coker gas oil with an major fraction of said virgin gas oil prior to said cracking step.

2. The improved process claimed in claim 1 wherein said recovered hydroprocessed coker gas oil has an aromatic carbon content of about 25%.

3. The improved process claimed in claim 1 wherein said hydroprocessing catalyst comprises cobalt-molybdenum oxides or sulfides on alumina support.

4. The improved process claimed in claim 1 wherein said hydroprocessing catalyst is a nickel-molybdenum on alumina catalyst.

5. The improved process claimed in claim 1 wherein said virgin gas oil is a vacuum gas oil.

* * * * *